US006735782B2

(12) United States Patent
Park

(10) Patent No.: US 6,735,782 B2
(45) **Date of Patent: *May 18, 2004**

(54) CAP WITH A FREELY TRANSFORMING VISOR

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/091,026

(22) Filed: Mar. 6, 2002

(65) Prior Publication Data

US 2003/0074716 A1 Apr. 24, 2003

(30) Foreign Application Priority Data

Oct. 23, 2001 (KR) ..... 2001-0065345

(51) Int. Cl.[7] ..... A42B 1/00
(52) U.S. Cl. ..... 2/175.5; 2/175.2; 2/195.6
(58) Field of Search ..... 2/175.1–175.5, 2/195.1–195.7, 12, 209.11

(56) References Cited

U.S. PATENT DOCUMENTS

| | | | | | |
|---|---|---|---|---|---|
| 2,686,917 | A | * | 8/1954 | Auerbach | 2/172 |
| 2,931,046 | A | * | 4/1960 | Klein | 2/195.6 |
| D289,700 | S | | 5/1987 | Burns | |
| 4,777,667 | A | | 10/1988 | Patterson | |
| 4,839,924 | A | | 6/1989 | Laurence | |
| 5,121,506 | A | * | 6/1992 | Ulrich | 2/171.5 |
| 5,450,629 | A | | 9/1995 | Gilstrap | |
| 5,657,490 | A | * | 8/1997 | Edmark | 2/182.1 |
| 5,669,071 | A | | 9/1997 | Vu | |
| 5,845,339 | A | * | 12/1998 | Ashley et al. | 2/195.6 |
| 5,901,371 | A | | 5/1999 | Lee | |
| 5,908,146 | A | | 6/1999 | Levin | |
| 6,061,835 | A | * | 5/2000 | Lien | 2/175.5 |
| 6,216,277 | B1 | * | 4/2001 | Cheng | 2/171.03 |
| 6,237,156 | B1 | | 5/2001 | Ellman | |
| 6,357,051 | B1 | * | 3/2002 | Lee | 2/195.1 |

* cited by examiner

*Primary Examiner*—Katherine Moran
(74) *Attorney, Agent, or Firm*—Jacobson Holman PLLC

(57) ABSTRACT

A baseball-style cap having a freely transformable visor which includes an upper fabric portion, a lower fabric portion, and a resilient stiffener placed therebetween. The cap further includes a piped fabric portion that is located between the upper and lower fabric portions, adjacent an outer periphery of such upper and lower portions, into which a deformable material is inserted. The deformable material includes a plastic sheath defining a channel, and a metal material lying within the channel and enclosed thereby. The combination of the resilient stiffener and the deformable material allows the visor to be readily bent or folded as well as easily restored to its original configuration. The resulting cap can be produced easily, is attractive in use and can be carried in a pocket without damage to the visor.

13 Claims, 6 Drawing Sheets

CAP WITH A FREELY TRANSFORMING VISOR

BACKGROUND OF THE INVENTION

1. Field of the Invention

The present invention is related to the field of caps having visors and, more particularly, to a baseball-style cap having a flexible yet shape-sustaining visor. This application is related to and commonly owned with a U.S. Patent Application entitled, CAP WITH A PLIABLE VISOR, filed concurrently herewith.

2. Description of the Related Art

As known in the prior art, a baseball style cap generally includes a crown main body and a visor portion that is secured to the forward edge of the crown and extends outwardly therefrom to provide protection from sunlight or rain. Such caps are widely used by persons of both sexes and all ages.

Typically, the visor portion includes a stiffening insert in order to reinforce the visor so that it can act to protect the wearer from sunlight. With conventional caps, the stiffening insert is not resilient such that, once bent or folded, the visor cannot be restored to its original shape. Therefore, the cap cannot be folded and placed into the wearer's coat or trouser pocket when not in use, because to do so would permanently deform the visor. The wearer is thus required to carry the cap in hand if he or she does not have a suitable bag or other carrying case within which to place the cap when it is not being worn. This is inconvenient and also increases the likelihood that the wearer, in setting the cap down to do something else, will leave the cap unintentionally.

Alternatively, caps having inserts made of flexible fabric materials have been used. These are easy to carry but, because the exterior of the visor has very little supporting capability, the visor becomes slack following laundering, rendering the flexible insert ineffective.

Therefore, a need exists for a cap having a flexible visor, allowing the cap to be conveniently carried when not being worn, which is also sufficiently stiff to provide desired protection from the elements. There is also a need for a freely transforming visor that can be shaped into and maintain different configurations, even when the shaping force is removed.

SUMMARY OF THE INVENTION

In view of the foregoing, one object of the present invention is to provide an improved cap structure that can support a visor and which is also convenient to carry when not being worn.

Another object of the present invention is a cap having a pliable, freely transforming, visor which can be manipulated into different shapes, and maintain such shapes, so as to be effective in use by individuals for a variety of outdoor purposes.

A further object of the invention is a cap having a visor that can be repeatedly deformed and reformed, in accordance with various needs, without damaging the outward form of the visor.

In accordance with these and other objects, the present invention is directed to a cap having a pliable, freely transformable visor which includes an upper covering portion, a lower covering portion, and a resilient stiffener placed therebetween. The cap further includes a piped covering portion that is located between the upper and lower covering portions, adjacent an outer periphery of such upper and lower portions, into which a deformable material is inserted. The deformable material includes a compressed molding having a channel therein, into which a metal material without restorative force is inserted.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
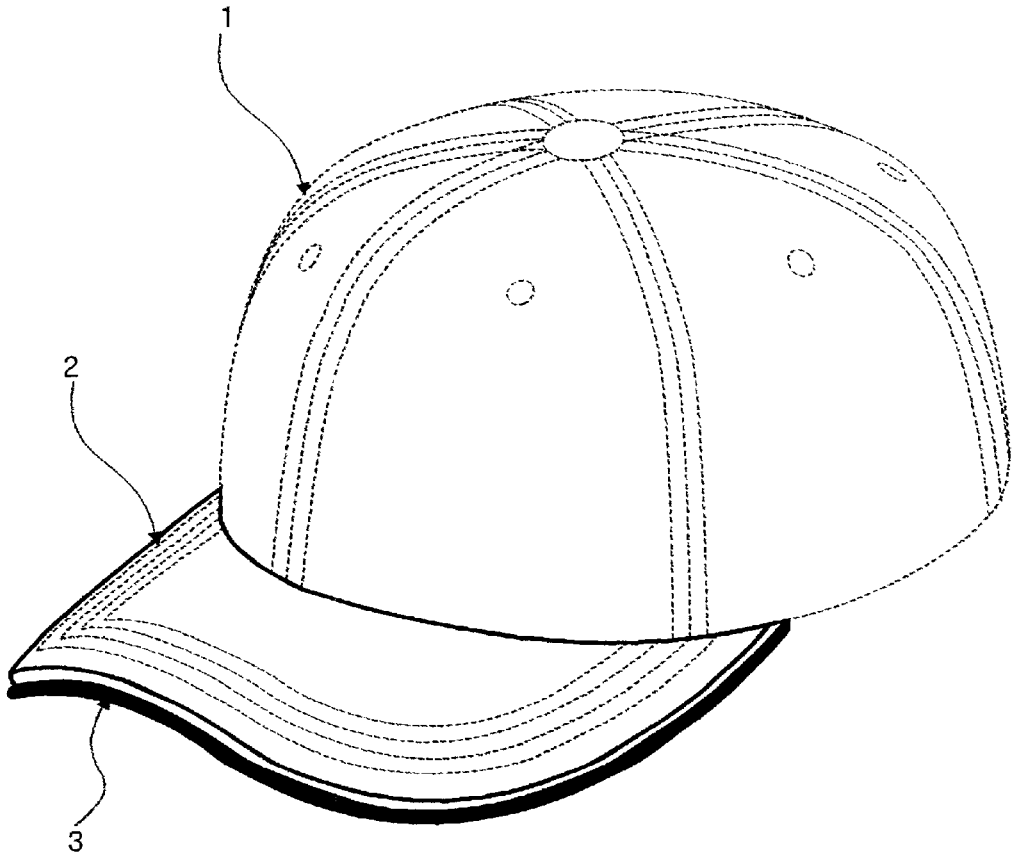
FIG. 1 is a perspective view of the cap according to the present invention.

In describing a preferred embodiment of the invention illustrated in the drawings, although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

In accordance with a preferred embodiment of the present invention, the present invention is directed to a baseball-style cap having a pliable, freely transformable visor. The structure of the visor includes a resilient stiffener and a deformable material. The resilient stiffener and deformable material are held in place by upper, lower and piped covering portions. The covering portions may be made of fabric, plastic, nylon, or any other similar material used to make clothing or clothing accessories. In the preferred embodiment, the covering portions are made of fabric and further discussion herein will refer to fabric portions; this is not meant to be limiting, however.

FIG. 1 is a perspective view of a cap with the freely transforming visor according to the present invention. As shown, the cap includes a crown portion 1 including a plurality of panels, and a visor portion 2 that is secured to the forward edge of the crown portion and extends outwardly therefrom. The visor 2 is covered on the top with a first fabric material 4, and a piped fabric portion 3 having the deformable material therein extends along the lower peripheral edge of the visor.

Figure 2:
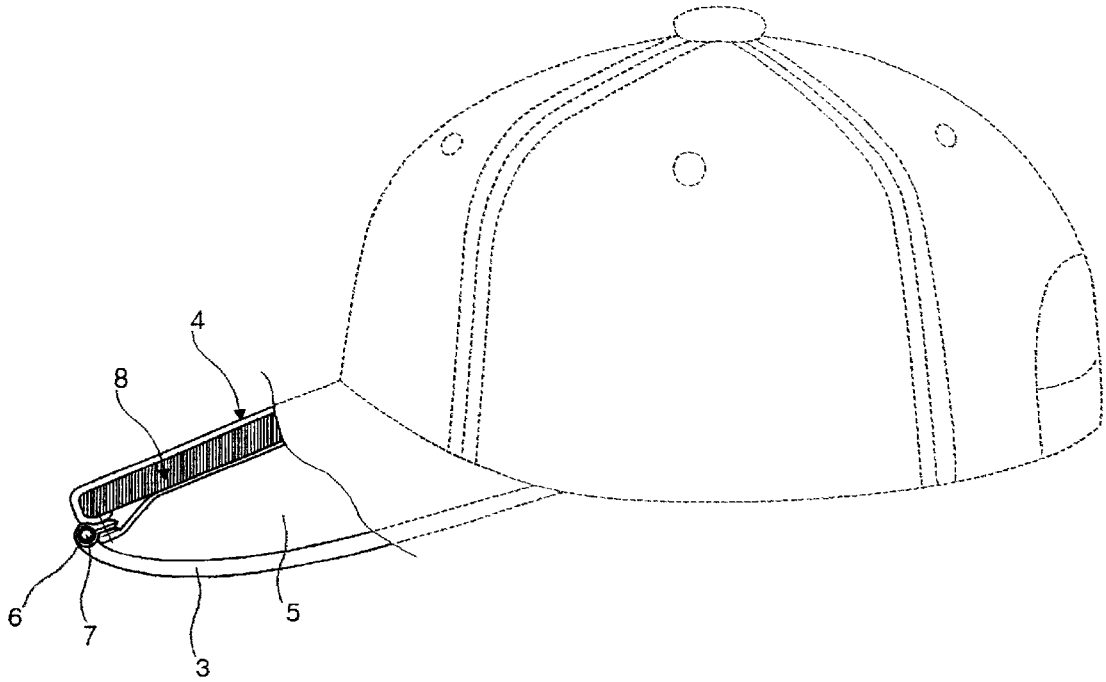
FIG. 2 is a side cross-sectional view of the visor of the cap of FIG. 1.

FIG. 2 is a side cross-sectional view of the cap according to the present invention. As illustrated, the visor includes a resilient stiffener 8 that supports the outward form of the visor. The first fabric material 4 covers the upper surface of the visor, and a second fabric material 5 covers the lower surface of the visor. The piped fabric portion 3 is located between the first and second fabric materials and is fastened, preferably by sewing, with said first and second fabric materials along the outer peripheral edge of the resilient stiffener 8. The deformable material includes a tube of soft compressed plastic or other molded material 6 defining a channel which is inserted into the piped fabric portion 3, and an elongated piece of pliable metal material 7 which lies within the channel.

The pliable metal material 7 may be any metal or metal-like material, preferably having limited or no restorative force. As a result, the deformable material substantially holds the shape into which it was last deformed, i.e., the material does not return to its original shape unless purposely remolded into the original shape. The metal material 7 is encased in the soft plastic or other molded material 6, which provides support to the highly bendable metal. Such soft plastic sheath ensures that, when transforming the shape of the visor by bending the metal material 7, the smooth peripheral edge of the visor is maintained, i.e., the metal is substantially prevented from being bent to such an acute degree that the continuity of the peripheral edge of the visor is ruined. By supporting the metal strand, the molded sheath also protects the metal strand from excessively acute bending which might, over time, stress the metal strand to the point of fracture.

The resilient stiffener 8 can be composed of hard materials such as cardboard, plastic, flexible plastic, etc. In a preferred embodiment, the resilient stiffener is made of an elastic fabric material which can strongly support the visor and also be transformed into various shapes into which it is held by the deformable material.

In the preferred embodiment shown, the plastic tube 6 and elongated piece of metal material 7 inserted into the tubular channel of the tube 6 are substantially the same length as the piped fabric portion. However, as a further alternative, the deformable material may be shorter than the piped fabric portion, being inserted into the most curved part of the visor, i.e., the outermost exterior edge of the visor end. Similarly, the strand of metal material may be shorter than the plastic molded tube.

Figure 4:
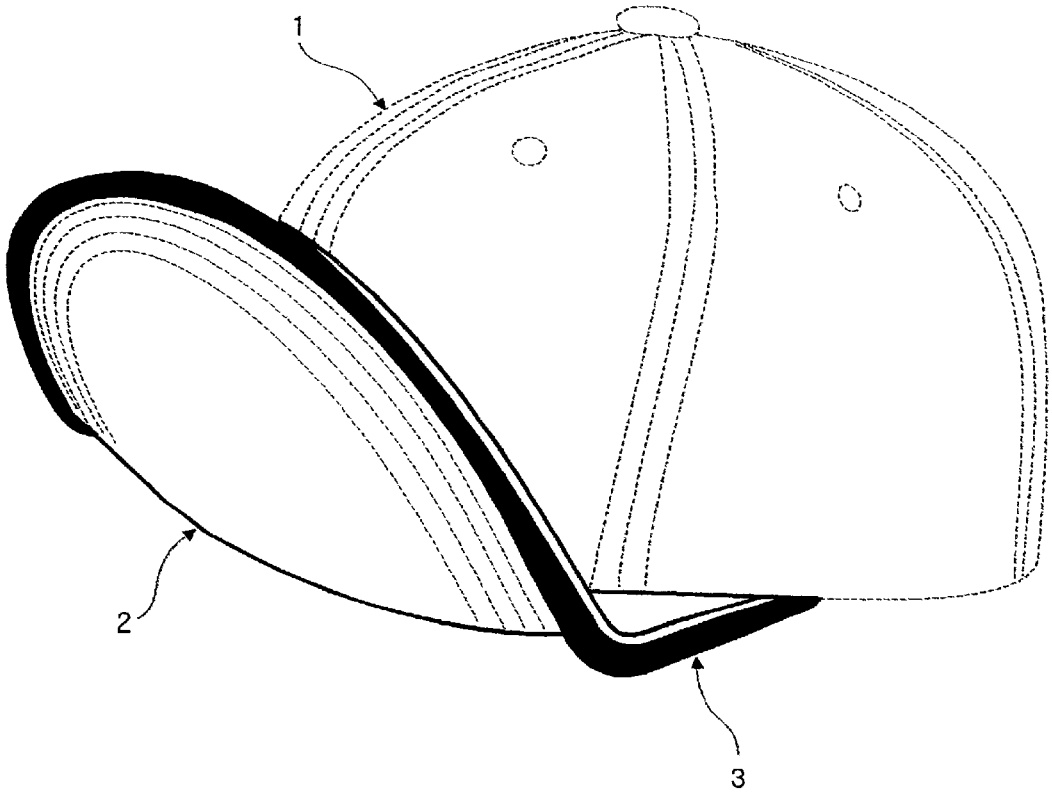
FIG. 4 is a perspective view of the cap according to the present invention with the visor in a folded-up configuration as in use.
Figure 5:
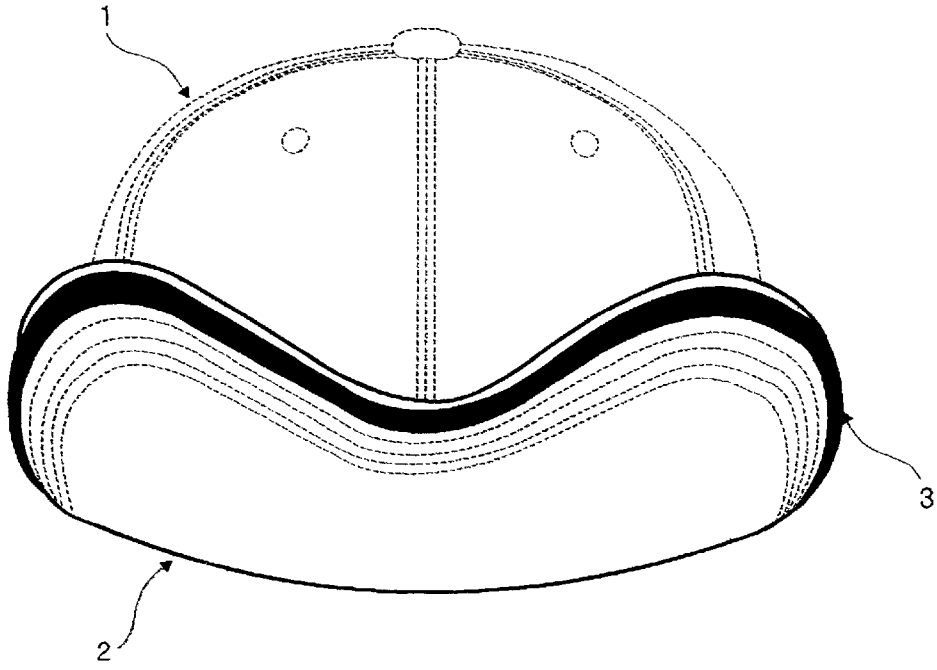
FIG. 5 is a front view of the cap according to the present invention with the visor in a folded-up and cupped configuration as in use.

Because of the pliable nature of the deformable material, the resulting visor may be shaped and reshaped to a far greater extent than a visor having only a stiffening insert. The advantage of this flexibility is seen in FIGS. 3, 4 and 5 which illustrate configurations of the cap when worn.

Figure 3:
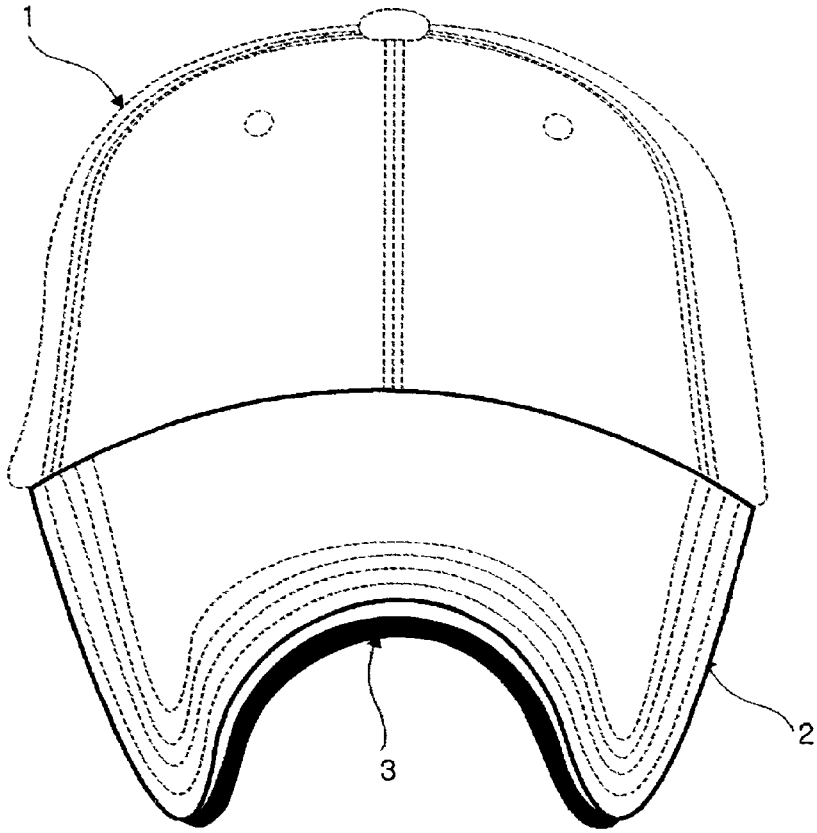
FIG. 3 is a front view of the cap according to the present invention with the visor in a cupped configuration as in use.

FIG. 3 shows a cap in which both sides of the visor have been cupped downward, with the centerline of the visor as the central axis. This cupped curvature is maintained by the resistance of the now reshaped metal material 7. Unlike prior art visors, the visor according to the present invention may thereafter be restored to its original form, even after the visor has been extremely bent and assumes a U-shape, without any damage to the outward form of the visor.

When using caps for outdoor purposes such as golfing and driving, the visor can oftentimes obstruct vision, requiring the wearer to remove the cap or turn it around so that the visor faces backward. With the present invention, however, the visor can be folded in a vertical direction as shown in FIG. 4. By folding the visor toward the front of the crown, there is no need to remove the cap or twist it about the head, which greatly increases convenience for the wearer. Similarly, the visor may be folded up and cupped, as shown in FIG. 5.

Figure 6:
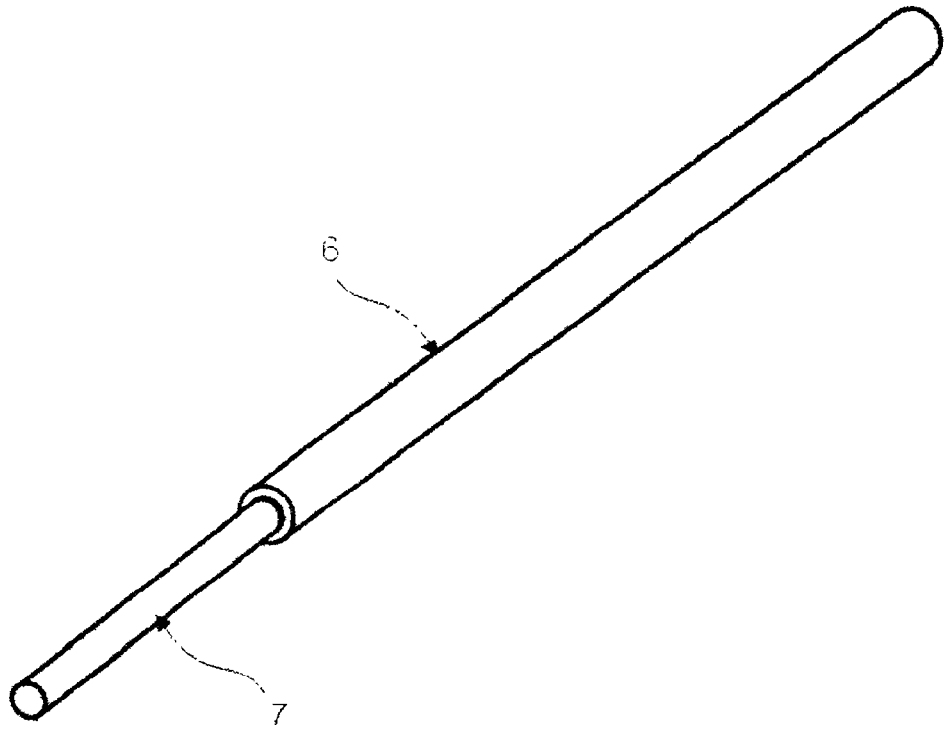
FIG. 6 is a perspective view of the deformable material according to the present invention.

The deformable material with pliable metal strand 7 and tube of molded material 6, into which the strand is inserted, is illustrated in FIG. 6.

The cap according to the present invention, with its combination of a resilient stiffener and a bendable, deformable metal material encased in a soft compressed plastic material, is very durable, maintaining the form of the visor even after repeated laundering. The visor can withstand repeated reshaping, and is easily restored to a standard visor configuration after being folded and carried in one's pocket.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the piped covering portion with deformable material therein may be incorporated into hats and caps of other styles. Therefore, it is not desired to limit the invention to the specific examples disclosed or the exact construction and operation shown and described. Rather, all suitable modifications and equivalents may be resorted to, falling within the scope of the invention.

What is claimed is:

1. A shapeable cap comprising:

a crown main body; and a pliable visor, said visor including, an upper fabric portion;

a lower fabric portion;

a piped fabric portion forming a tubular channel, said piped fabric portion being substantially aligned with and between an outer circumference of said upper fabric portion and an outer circumference of said lower fabric portion;

a resilient stiffener inserted between said upper fabric portion and said lower fabric portion, a forward edge of said resilient stiffener abutting said piped fabric portion; and a deformable material inserted into said tubular channel, said deformable material including a compressed molding portion and a metal portion, wherein said metal portion is a metal material without restorative force and is inserted within a channel formed by said compressed molding portion.

2. The cap as set forth in claim 1, wherein said compressed molding portion is tubular, defining a channel, and said metal portion is an elongated member lying within said channel.

3. The cap as set forth in claim 2, wherein said resilient stiffener is an elastic fabric material.

4. The cap as set forth in claim 2, wherein said compressed molding portion is soft plastic.

5. The cap as set forth in claim 1, wherein said compressed molding portion is soft plastic.

6. The cap as set forth in claim 1, wherein said cap is baseball-style cap.

7. A supple baseball-style cap comprising:

a crown main body; and a transformable visor, said visor including, an upper covering portion;

a lower covering portion;

a resilient stiffener inserted between said upper portion and said lower portion; and a tubular strand of deformable material substantially aligned with and between an outer circumference of said upper portion and an outer circumference of said lower portion, said strand including a tubular molded portion defining a channel and a metal portion lying within said channel, wherein said metal portion is a wire without restorative force.

8. The baseball-style cap as set forth in claim 7, wherein said molded portion is soft plastic.

9. The baseball-style cap as set forth in claim 7, wherein said upper covering portion is fabric.

10. The baseball-style cap as set forth in claim 7, wherein said lower covering portion is fabric.

11. The baseball-style cap as set forth in claim 7, wherein said tubular strand is covered by a piped fabric portion which is fastened to said upper and lower covering portions.

12. The baseball-style cap as set forth in claim 11, wherein said upper and lower covering portions are fabric and are sewn to said piped fabric portion.

13. The baseball-style cap as set forth in claim 12, wherein said molded portion is soft plastic.

* * * * *